United States Patent [19]

Rees

[11] 4,388,780

[45] Jun. 21, 1983

[54] ELECTRIC POWERED WET STONE

[75] Inventor: Spencer C. Rees, Sugar Grove, Ill.

[73] Assignee: Wen Products, Inc., Chicago, Ill.

[21] Appl. No.: 221,558

[22] Filed: Dec. 31, 1980

[51] Int. Cl.[3] ..... B24B 3/36

[52] U.S. Cl. ..... 51/128; 51/267

[58] Field of Search ..... 51/128, 125, 109 R, 51/109 BS, 267

[56] References Cited

U.S. PATENT DOCUMENTS

| | | | |
|---|---|---|---|
| 1,711,015 | 4/1929 | Dailey | 51/109 R |
| 2,318,764 | 5/1943 | Dorris | 51/128 |
| 2,722,783 | 11/1955 | O'Russa | 51/128 |
| 2,775,075 | 12/1956 | McMaster | 51/128 |

FOREIGN PATENT DOCUMENTS

| | | | |
|---|---|---|---|
| 1389215 | 4/1975 | United Kingdom | 51/128 |

OTHER PUBLICATIONS

Popular Mechanics Dec. 1978 p. 23.

*Primary Examiner*—Harold D. Whitehead

*Attorney, Agent, or Firm*—Hill, Van Santen, Steadman, Chiara & Simpson

[57] ABSTRACT

An apparatus is provided for sharpening, grinding, polishing or honing metal objects which has a motor driven vertically mounted grinding wheel provided with a stream of water which can be recirculated to cool the grinding wheel. The device is provided with an adjustable guard to be mounted at the top of the device which has formed in it several guide means for use in sharpening various tools. A pivotable guard plate can be selectively locked throughout a range of angles with respect to the grinding wheel to provide an appropriate support surface. The guard can be adjusted upwardly and downwardly to accommodate wearing down of the grinding wheel and to adjust the grinding angle.

20 Claims, 9 Drawing Figures

FIG. 3
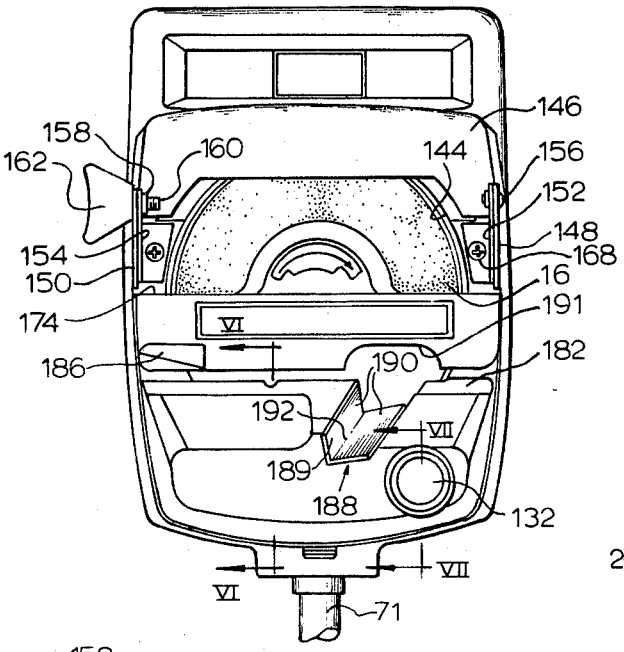
FIG. 5
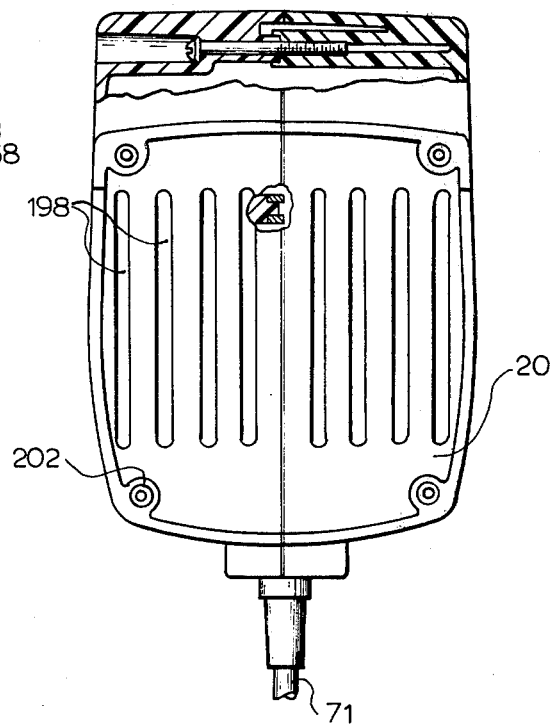
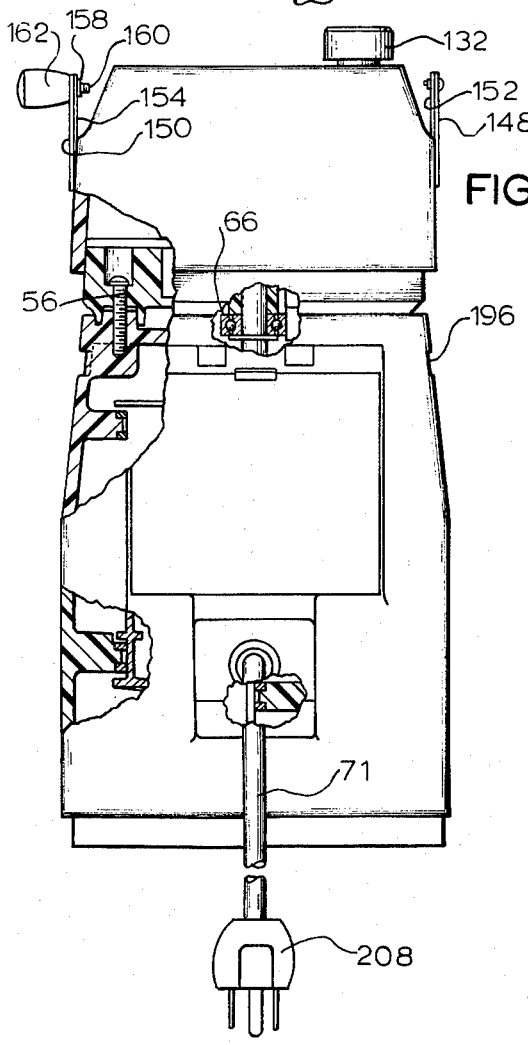
FIG. 4
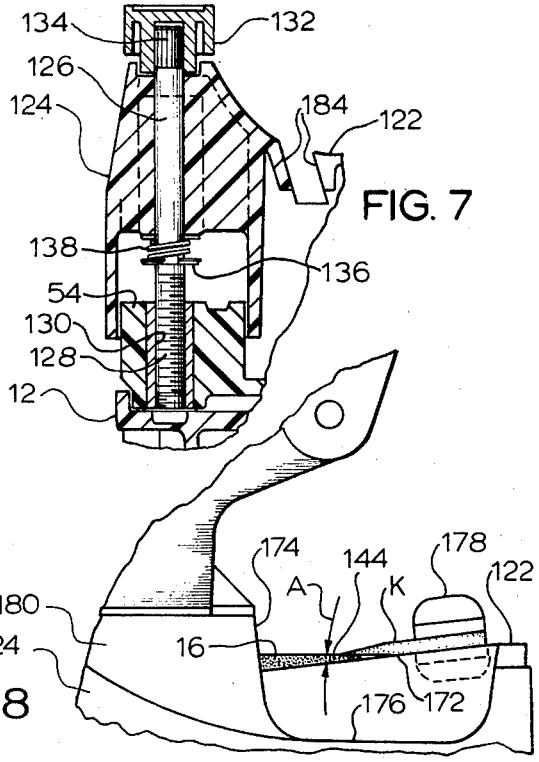
FIG. 7
FIG. 8

ELECTRIC POWERED WET STONE

BACKGROUND OF THE INVENTION

1. Field of the Invention

This invention relates to an apparatus for grinding and sharpening metal objects by means of a wet grinding wheel and more specifically to an electric powered whet stone device.

2. Description of the Prior Art

Sharpening metal objects by means of a grinding wheel is generally known in the art. It is also known in the art to provide water or other liquids such as oil to a grinding stone to aid in the grinding, sharpening or polishing of the metal object. Further, there is a device available in the art for providing a wet flat horizontal grinding surface for use in sharpening and honing metal tools. There are several problems associated with the devices in the prior art which the present invention resolves.

The prior art provides for a water conduit or feed line which is exterior of the body or housing of the device which can be easily broken or displaced by bumping it with a tool which is being sharpened or ground. This can cause water to be sprayed around the work place during the operation of the machine.

The prior art device also provides for an open water receptacle which is accessible by the hands of the user which may result in safety problems in that the device is powered by electricity.

The prior art device provides for the grinding wheel and a pump to be positioned on the same side of the motor and both being driven by the motor shaft which is necessarily extended well beyond the bearing member contained in the motor housing. This arrangement causes an increased loading of the motor resulting in possible stalling of the motor or requiring a larger and more powerful motor which necessarily consumes more energy.

The prior art device further provides only a direct opening to the flat upper surface of the grinding wheel and does not provide any guide means for determining the proper angle to be used in sharpening various tools.

SUMMARY OF THE INVENTION

The present invention provides for an improvement over the existing art and resolves the problems in the prior art identified above.

The invention provides for a motor driven vertically mounted grinding wheel provided with a stream of water which can be recirculated to cool the grinding wheel. A pump is provided at an opposite end of the motor from the grinding wheel to permit a first bearing member to be located close to the grinding wheel and a second bearing member to be located close to the pump for reducing the load on the motor. The placement of the pump at the opposite end of the motor from the grinding wheel tends to balance the loads on the motor, thereby permitting a smaller motor to be used to rotate the grinding wheel.

The water used in the cooling of the grinding wheel is stored in a receptacle located in a side wall of the device housing. The conduits leading to the pump from the receptacle and from the pump and directed to the top surface of the grinding wheel are all enclosed within the housing and guard of the device preventing any accidental bumping and dislodging of the conduits. Additionally, the entire water flow system is essentially closed and not accessible by hand from the exterior of the device thus promoting safety in the operation of the electric device.

The invention also provides for an adjustable guard to be mounted at the top of the device which has formed in it several guide means for use in sharpening various tools. Specifically, there is a slot to be used in sharpening scissors, a notch to be used in sharpening drill bits and a rotatable or pivotable guard plate, positioned adjacent a large exposed arc of the grinding wheel, which when used provides a support surface for sharpening small objects at selected desired angles and can be rotated to a position away from the grinding wheel to provide access to a larger area of the grinding wheel for sharpening large objects. The guard plate contains indicia to aid the user in selecting the correct desired sharpening angle. The guard can be adjusted upwardly and downwardly to accommodate wearing down of the grinding wheel and to adjust the grinding angle.

The invention provides for a relatively small device easily movable from place to place within a work shop or other area of use and which is provided with suction feet for retaining the device in a select location. Also, the device may be anchored in a permanent location by means of bolts threaded through openings provided in the bottom wall of the device.

DESCRIPTION OF THE DRAWINGS

FIG. 3 is a top elevational view of the device shown in FIG. 1.

FIG. 4 is a rear elevational view of the device shown in FIG. 1 partially cut away to show various internal parts of the device.

FIG. 5 is a bottom elevational view of the device shown in FIG. 1 partially cut away to show the interior of parts of the device.

FIG. 7 is a partial sectional view taken along the lines VII—VII of FIG. 3.

FIG. 8 is a partial side elevational view of the guard shown in FIG. 1.

DESCRIPTION OF THE PREFERRED EMBODIMENTS

Figure 1:
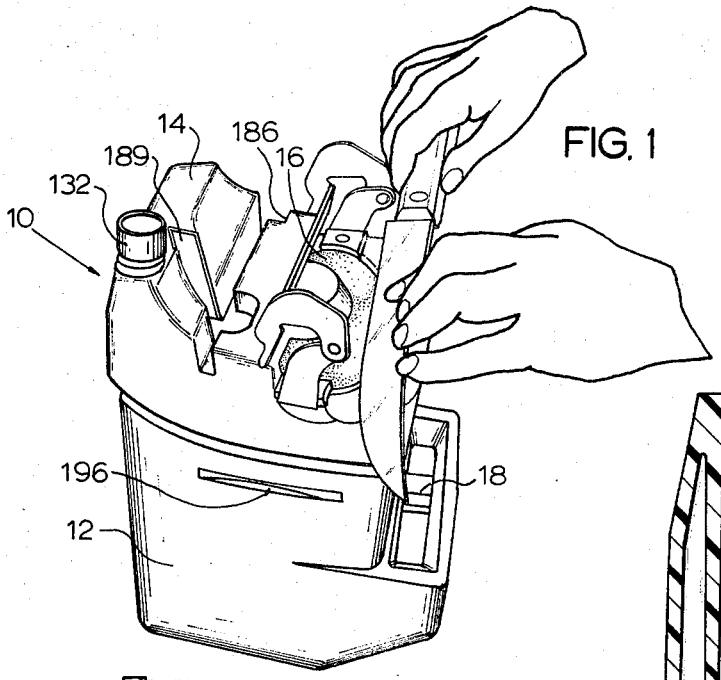
FIG. 1 is a perspective view of the electric powered whet stone apparatus.

In FIG. 1 an apparatus for sharpening, grinding, polishing or honing metal objects is shown generally at 10 and is comprised of a housing or casing 12, a guard member 14, an annular grinding wheel or stone 16 and a power switch 18 for selectively energizing the device 10.

Figure 2:
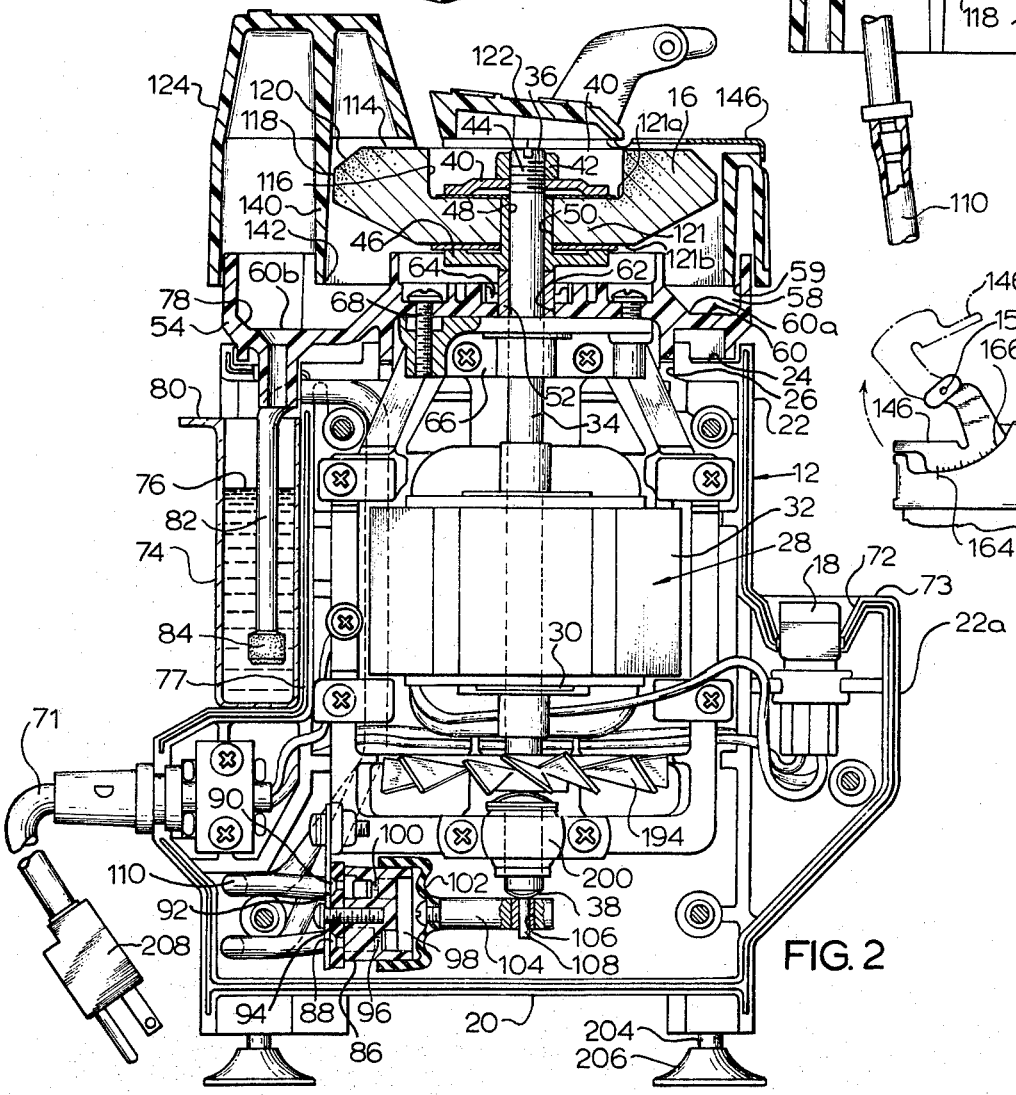
FIG. 2 is a side sectional view of the apparatus showing some portions in elevation.

The various components of the device are best seen in FIG. 2 wherein it is seen that the housing 12 is comprised of a bottom wall 20, side walls 22 and has a top wall 24 with an opening 26 located therein.

The housing 12 encloses an electric motor 28 which is comprised of a rotor 30 and a stator 32 and thus acts as a motor casing. The rotor 30 is attached to a rotatable shaft 34 which has a top end 36 and a bottom end 38 extending beyond the top and bottom respectively of the motor 28. The grinding wheel 16 is mounted at the top end 36 of the shaft 34 to corotate therewith by means of a corotating top flange 40 and a retaining means such as a nut 42 which can be secured to a threaded portion 44 of the top end 36 of the shaft 34. The grinding wheel 16 is additionally secured to the shaft 34 by means of a bottom flange 46 which has a hollow cylindrical portion 48 sized to receive the shaft 34 and be received in a central opening 50 through the grinding wheel 16. The bottom flange 46 is corotatable with the shaft 34 and abuts against a seal sleeve 52. Seal sleeve 52 corotates with shaft 34 and is used to prevent water from entering the interior of the housing 12 containing the motor 28.

A center plate 54 is provided to rest on the top wall 24 of the housing 12 and is to be secured thereto by appropriate fastening means such as screws 56 as seen in FIG. 4. Referring back to FIG. 2, it is seen that the center plate has formed in a top side thereof, an annular channel or sump 58 which has an outer circumferential side wall 59 and a sloping bottom wall 60 having a high point at 60*a* and a low point at 60*b*. The side wall 59 essentially forms a continuation of side wall 22 of the housing 12. The center plate 54 further has a central opening therein at 62 for receiving the shaft 34 and the seal sleeve 52. A seal member 64 is provided between the rotatable seal sleeve 52 and the non-rotatable center plate 54.

The seal sleeve 52 abuts at an end opposite the bottom flange 46 against a bearing member 66 which is secured to the center plate 54 by appropriate fastening means such as screws 68. As best seen in FIG. 4, the bearing means 66 may be comprised of a ball bearing element.

Thus, by means of these various elements, the grinding wheel 16 is mounted at the top end 36 of the shaft 34 at a spaced distance from the top wall 24 of the housing 12. The bearing means 66 for the motor shaft 34 is located proximate to the grinding wheel 16. The motor 28 is secured to the interior of the housing 12 by appropriate fastening means.

The power switch 18 is located in an extension 22*a* of the side wall 22 of the housing 12 and provides means for selectively energizing the motor 28 with electricity supplied through power cord 71. The power switch 18 is positioned in a well 72 such that the switch is below a top wall 73 of the extension 22*a*. This prevents the switch from being turned on or off accidentally.

A receptacle 74 for receiving and storing a liquid 76 such as water is provided in a recess 77 in the side wall 22 of the housing 12 immediately below the low point 60*b* of the bottom wall 60 of the sump portion 58 of the center plate 54. A drain hole 78 is provided in the low point 60*b* of the bottom wall 60 of the sump 58 allowing drainage of any accumulated water into the receptacle 74. A protruding handle 80 is provided at the top of the receptacle 74 for aiding in the removal of the receptacle 74 from its location in the side wall 22 of the housing 12 for refilling or cleaning the receptacle 74. A conduit 82 having a filter element 84 connects the interior of the receptacle 74 with a pump means 86 having an inlet 88 and an outlet 90.

The pump means 86 is positioned below the motor 28 and is retained in place by means of a mounting plate 92 and appropriate fastening means 94 such as a screw. Interior of the inlet 88 of the pump 86 is a one-way valve means 96 which permits water to flow through the inlet 88 into a chamber 98 within the pump body but does not allow water to flow back out through the inlet 88. The pump chamber 98 communicates with the outlet 90 by means of a second one-way valve means 100 which permits water to flow out through the outlet 90 but does not permit water to flow back into the chamber 98.

A rear wall 102 of the pump means 86 is comprised of a flexible diaphragm which can be oscillated in and out to provide for lesser or greater volume within the chamber 98. As the volume of the chamber 98 is increased, water is drawn into the chamber 98 through the inlet means 88 through the first one-way valve 96. As the volume of the chamber 98 is decreased, the first one-way valve 96 closes and the second one-way valve 100 opens permitting water to flow out through the outlet 90 of the pump means 86.

A rod 104 is connected to the exterior of the rear wall 102 of the pump means 86 and has a perpendicular hole 106 therethrough to receive a pin 108 which is formed as an integral part of the lower end 38 of the shaft 34. The pin 108 is offset slightly from the axis of the shaft 34 such that rotation of the shaft 34 will cause the pin to move in a small circular path in turn causing the rod 104 to oscillate back-and-fourth and thereby increasing and decreasing the volume of the chamber 98 within the pump means 86.

Figure 6:
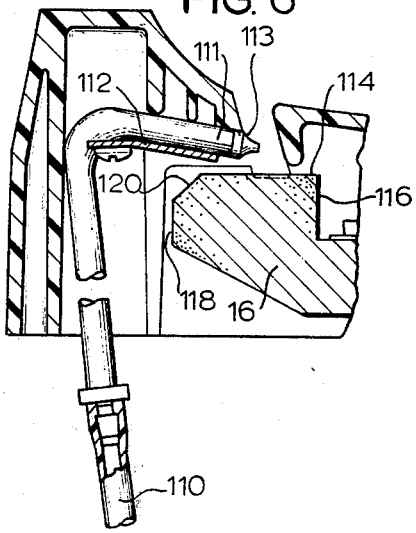
FIG. 6 is a partial sectional view taken along the lines VI—VI of FIG. 3.

As the pump is thus driven by the shaft 34 of the motor 28, water exits the pump means 86 through the outlet 90 into a conduit or hose 110 which is routed up through the interior of the housing 12 and up into the guard member 14 to a position above the grinding wheel 16 as best seen in FIG. 6. The end 111 of the conduit 110 is retained in place by means of mounting bracket 112. A spigot 113 is provided at the end 111 to direct the water toward the grinding wheel 16.

The grinding wheel 16 is comprised of an annular wheel mounted on the vertical shaft 34 and it has a flat top or upper surface 114 which is bounded by an inner circumferential wall 116 and an outer circumferential wall 118. There is a chamfer or bevel 120 at the joint between the outer wall 118 and the top surface 114. The chamfer 120 is provided to prevent the water from being flung off from the top surface 114 of the grinding wheel 16 by centrifugal force while the wheel is rapidly spinning. Since the top surface 114 of the wheel 16 is located above parts of the housing for access thereto during the sharpening or grinding process, without the bevel 120, water would be flung about the work place and on the operator of the device. The grinding wheel 16 is made of a water porous abrasive material such as a vitrified bonded aluminum oxide.

In order to perform the different functions such as grinding, honing, sharpening, and polishing, grinding wheels of different degrees of abrasiveness are used. The grinding wheel 16 is located above the top wall 24 of the housing 12 and is enclosed within the guard 14. The grinding wheel 16 has a relatively thin center section 121 which has a top wall 121*a* that abuts the top flange 40 and a bottom wall 121*b* that abuts the bottom flange 46. The central opening 50 is located in the center of the center section 121.

The guard 14 has a top wall 122, side walls 124 and an open bottom and is sized to be received by the side walls 59 of the center plate 54 which are extensions of the side wall 22 of the housing 12. The guard 14 is removably attached to the housing 12 by means of an adjustment stud 126 as best seen in FIG. 7. A threaded end 128 of the stud 126 is received in a threaded opening 130 in the center plate 54 which in turn is attached to the housing 12. An adjustment knob 132 is attached at a knurled end 134 of the stud 126 and is used to manually rotate the stud. A C-ring 136 and spring 138 arrangement are used to retain the stud 126 and the guard 14 in a fixed axial arrangement.

By turning the knob 132 which in turn rotates the stud 126, the guard 14 can be selectively raised or lowered with respect to the housing 12. An interior wall 140 of the guard 14 has a bottom end 142 which abuts against the bottom wall 60 of the channel 58 in the center plate 54 to provide an effective stop in the downward movement of the guard 14 with respect to the housing 12.

The guard 14 has a relatively large C-shaped opening 144 in the top wall 122 as best seen in FIG. 3. This opening provides access to the flat top surface 114 of the grinding wheel 16 through 180° of arc of the grinding wheel 16.

A selectively pivotable guard plate 146 as best seen in FIG. 3, has a pair of upstanding arms 148, 150 which are pivotally attached to brackets 152, 154. Arm 148 may be attached to bracket 152 and 156 in a pivotable manner such as with a rivet. Arm 150 may be attached to bracket 154 at 158 in a pivotable manner by means of a threaded screw 160 which has an oversized knob 162 mounted thereon. The knob and screw arrangement is used to selectively lock the arm 150 with respect to the bracket 154 so as to hold the guard plate 146 in a selected position.

Figure 9:
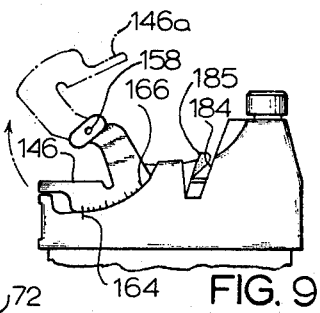
FIG. 9 is a partial side elevational view of the guard shown in FIG. 1 further showing the pivotal guard plate.

As seen in FIG. 9, the guard plate 146 is pivoted about point 158 as shown at 146*a* such that the guard plate 146 will be rotated to a position away from the grinding wheel to provide access to a larger area of the grinding wheel for sharpening large objects as is shown in FIG. 1. Referring further to FIG. 9, an index mark 164 is provided on the guard 14 to be used in conjunction with indicia 166 carried on arm 150 which indicates the angle between the surface of the guard plate 146 and the top surface 114 of the grinding wheel. In this manner, a precise angle may be selected by the user which is appropriate for the grinding or sharpening of the tool being used.

Brackets 152 and 154 are secured to the top wall 122 of the guard 14 by appropriate fastening means such as screws 168. Thus the guard plate 146 acts as a support surface for resting the intermediate portion of small tools while sharpening or grinding the ends of the tools. Since different types of tools have variously angled surfaces requiring sharpening or grinding, the adjustable and pivotable guard plate provides an appropriate resting surface for any angle required.

As best seen in FIG. 8, a portion of the top wall 122 of the guard 14 is sloped slightly downwardly as at 172 toward the center of the grinding wheel adjacent the opening 144 to provide for a proper sharpening angle A such as 10° for sharpening large objects. A stop 174 is provided on both sides of the opening and defines a chord on the grinding wheel 16 which intersects two points on the outer circumferential wall 118 of the grinding wheel 16 and which is tangential to, but radially outward from the interior circumferential wall 116 of the grinding wheel 16 and thus defines the maximum length of the uninterrupted top surface area of the grinding wheel 16. The arc of the grinding wheel within this chord is at least 110°.

The side walls 124 of the guard 14 are provided with pockets 176 to accommodate the handle portion 178 of a tool such as knive K which is being sharpened such that the full length of the blade may be brought to rest against the top surface 114 of the grinding wheel 16. Additionally, a small recess 180 is provided in side wall 124 for the arms 148, 150 of the guard plate 146. This provides for added stability of the guard plate 146 and aids in the accurate positioning of the indicia 166 with respect to the index mark 164.

A second opening 182 in the top wall 122 of the guard 14 is a slot which has side walls 184 which extend across the width of the top wall 122 of the guard 14 and the slot opening 182 provides access to another chord of the grinding wheel 16. The side walls 184 of the slot opening 182 are parallel to each other and are angled approximately 15° to the vertical axis of the shaft 34. This angled slot opening 182 is provided for sharpening long thin objects such as scissors blades 185 as shown in FIG. 9 and a small notch 186 is provided at one end of the slot 182 for accommodating a second scissors blade near the swivel pin of the scissors.

A third opening 188 being an inclined notch 189 having side walls 190 and an enlarged access opening 191 is formed in a portion of the top wall 122 of the guard 14 and provides access to the flat upper surface 114 of the grinding wheel 16. The side walls 190 of the notch form a joint 192 which is angled approximately 28° to the vertical axis of the shaft 34. This notch is provided for use in the sharpening of tools such as drill bits which require a steep sharpening angle.

As the top surface 114 of the grinding wheel 16 is worn down through use and by dressing the wheel 16 to maintain a smooth upper surface 114, the guard 14 can be adjusted downwardly by means of the knob 132. This allows the top wall 122 of the guard 14 to be maintained in a desired spaced relationship with the top wall 114 of the grinding wheel 16. The downward movement of the guard 14 with respect to the housing 12 is limited by the bottom end 142 of the interior wall 140 as described above and the allowable travel of the guard 14 corresponds generally with the useful thickness of the grinding wheel 16 such that the guard 14 will "bottom out" at the point where a minimum thickness of the grinding wheel 16 is left for sharpening.

A fan 194 is provided on the shaft 34 which causes air to flow into the housing 12 through an air vent opening 196 in the side wall 22 of the housing 12. The air flows across the motor 28 thereby cooling the motor and is forced out of the housing through slots 198 in the bottom wall 20 of the housing 12 as best seen in FIG. 5.

A second bearing means 200 is located on the shaft 34 adjacent the bottom end 38 and below the fan 194. The bearing means 200 provides radial support for the bottom end 38 of the shaft 34 and is proximate to the driving pin 108 of the shaft 34 which drives the pump means 86. By providing the bearing means 200 close to the load associated with the pin 108, the effective load on the motor is reduced.

The bottom wall 20 of the housing 12 is provided with four threaded openings 202 as best seen in FIG. 5, which can receive leg members 204, best seen in FIG. 2, which are provided with suction cup feet 206 for securing the device 10 on a work bench or other area and allowing for selectively moving the device 10 from place to place. Alternatively, the threaded openings 202 may be aligned with pre-drilled holes in a work bench and may receive bolts or other appropriate fastening means to secure the device in a more or less permanent position on a work bench.

The device embodying the present invention is therefore operated in the following manner. A suitable work place is established and the device 10 is placed on a smooth surface and is pressed downwardly slightly to engage the suction feet 206 with the working surface. A plug 208 at the end of the power cord 71 is connected with an electrical outlet providing current for the device 10. The water receptacle 74 is cleaned and filled with fresh water 76 and is placed within the recess 77 in the side wall 22 of the housing 12. Switch 18 is moved into the "on" position, thereby completing the electrical circuit to the motor causing shaft 34 to rotate which in turn drives the grinding wheel 16 and the pump 86.

As the pin 108 is rotated away from the pump 86, the connecting rod 104 pulls on the diaphragm rear wall 102 causing chamber 98 to expand. The water 76 is thus drawn from the receptacle 74 through the filter means 84 and the first conduit 82 in through the inlet 88 of the pump means 86. As the pin 108 rotates toward the pump 86, the connecting rod 104 pushes on the diaphragm rear wall 102 causing chamber 98 to decrease in volume which causes the water 76 to be forced through the outlet 90 through conduit 110 up through the housing 12 and into the guard member 14. The spigot 113 and the end 111 of the conduit 110 directs the water to a point on the top flat surface 114 of the grinding wheel 16 near the inner circumferential wall 116.

The water is then absorbed into the porous grinding wheel 16 and centrifugal force created by the rotation of the grinding wheel causes the water to flow through the grinding wheel 16 toward the outer circumferential wall 118 where it is spun off. The bevel 120 prevents the water from being spun off into the work area and thus the excess water is thrown against the interior wall 140 of the guard 14 from which it gravitationally drips into the annular sump or channel 58 of the center plate 54. The inclined bottom wall 60 of the sump 58 directs the water to the low end **60*b* of the sump 58 where it flows through the drain hole 78 back into the receptacle 74** for reuse.

Once the grinding wheel 16 is saturated with water, metal objects may be sharpened, ground, polished or honed by applying them against the rotating flat upper surface 114 of the grinding wheel 16. Small tools, such as chisels, may be sharpened by resting the tool on the guard plate 146 which has been pivoted to the correct angle and locked in place by knob 162 and applying the edge of the tool against the flat upper surface 114 of the grinding wheel 16. Larger objects, such as knives or mower blades, may be sharpened by first loosening the knob 162, pivoting the guard plate 146 away from the grinding wheel, locking the guard plate in that position and then resting the metal object directly on the flat upper surface 114 of the grinding wheel 16 or using the sloping portion 172 of the top wall 122 of the guard 14 for support. Scissors may be sharpened by using the slot-type opening 182 and tools such as drill bits may be sharpened by using the inclined notch opening 188.

As the grinding stone 16 wears down, the guard 14 can be adjusted downwardly by means of the adjusting knob 132 such that the flat upper surface 114 of the grinding wheel 16 is always readily accessible. The guard 14 may be removed from the housing 12 when the device is turned off to provide access to the nut 42 and upper flange 40 for removal of the grinding wheel 16 for replacement with a different grinding wheel. Cleaning of the device is also facilitated with the guard 14 removed.

The device is small enough and portable enough that it may be moved and stored in a relatively small space when not in use, thereby freeing up valuable work space. Therefore, the present invention provides for a device 10 for grinding, sharpening, polishing and honing metal objects which comprises a housing 12 having a bottom wall 20, side walls 22 and a top wall 24 with an opening 26 therethrough. An electric motor 28 is enclosed with the housing 12 and has a vertical rotatable shaft 34 therethrough. The shaft has a top end 36 and a bottom end 38 extending beyond the top and bottom respective of the motor 28. An annular abrasive grinding wheel 16 having a flat top surface 114 is removably mounted near the top end of the shaft to corotate therewith. The wheel 16 and the top end of the shaft 36 protrude beyond the top wall 24 of the housing 12 through the opening 26.

A guard member 14 is provided having a top wall 122, side walls 124 and an open bottom being sized to engage the side walls 22 or extensions 58 thereof of the housing 12 at the top end and is removably attached to the housing 12. The guard member 14 encloses the grinding wheel 16 and has at least one opening 144 through the top wall 122 providing access to the flat upper surface 114 of the wheel 16.

A selectively pivotable guard plate 146 is provided which can be locked into a range of selected angles with respect to the top surface 114 of the grinding wheel 16 to provide for accurate sharpening of small tools.

The shaft 34 is journaled through a first load bearing means 66 below but proximate the wheel 16 for reducing the load on the motor 28. A removable receptacle 74 for storing and receiving water is provided and is engageable with the side wall 22 of the housing 12. A pump means 86 having an inlet 88 and outlet 90 is provided at the bottom end of the motor 28 and is driven by the bottom end 38 of the shaft 34. The bottom end 38 of the shaft 34 is journaled through a second load bearing means 200 above but proximate to the pump 86. Conduit means 82 are provided which connect the receptacle 74 with the pump inlet 88 and second conduit means 110 direct water from the pump outlet 90 to the flat upper surface 114 of the grinding wheel 16. Water collection means 140, 58 are provided radially outward from and below the beveled grinding wheel 16 for collecting excess water supplied to the wheel 16 and for returning the water to the receptacle 74 for reuse.

As is apparent from the foregoing specification, the invention is susceptible of being embodiment with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. An electric grinding machine comprising:

a housing enclosing an electric motor having a vertically disposed rotatable shaft extending through and above a top wall of said housing, an annular grinding wheel removably mounted at an upper end of said shaft to be corotatable with said shaft about a vertical axis, said grinding wheel having a flat upper surface positioned above said top wall of said housing and having a bevel at the outer circumference of said upper surface whereby an outer circumference of said wheel is greater below said bevel than at said upper surface, a guard having vertical side walls removably mounted to said housing, above said housing and enclosing said grinding wheel, said guard being vertically adjustable and having a low limit position where a portion of the guard is in contact with said upper surface of said grinding wheel, said guard having at least one opening therein defining an upper edge of said side walls for providing access to said flat upper surface of said grinding wheel, said outer circumference of said wheel, below said bevel, remaining below said upper edge of said side walls and not horizontally exposed through said guard opening when said guard is in said low position, a receptacle for storing water carried within said housing, a pump driven by said motor for moving said water from said receptacle and directing said water to said flat upper surface of said grinding wheel through conduits, and means for collecting excess water from said grinding wheel and returning said water to said receptacle, whereby water directed to said grinding wheel will be flung from said outer circumference of said wheel upon rotation of said wheel against said guard even when said upper surface is exposed above said upper edge.

2. The device of claim 1, wherein said pump is located below said motor and is driven by an extension of said shaft of said motor protruding below said motor.

3. The device of claim 1, wherein said annular grinding wheel is made of a porous material.

4. The device of claim 1, wherein said housing has air vent means provided in said side walls and said bottom wall and a means for moving air being driven by said motor shaft.

5. The device of claim 1 including a pivotable guard plate attached to said guard adjacent said opening in said guard and movable with respect to said grinding wheel.

6. The device of claim 5, wherein pivoting of said guard plate away from said grinding wheel exposes said flat upper surface of said grinding wheel in an area of no less than 110° of arc.

7. The device of claim 1 wherein said receptacle for storing water is enclosed within said housing and said conduits are routed within said housing and said guard so as not to protrude therefrom.

8. A device for sharpening metal objects comprising:

a housing having a bottom wall, side walls and a top wall, an electric motor carried within said housing having a vertically disposed shaft therethrough and extending beyond the top and bottom ends of said motor defining a vertical axis, an annular grinding wheel removably mounted at a top end of said shaft to corotate with said shaft about said vertical axis, said grinding wheel having a flat upper surface defined between an outer beveled edge at the top of a vertical circumferential wall and an inner vertical circumferential wall, said outer circumferential wall having a diameter less than the distance between said side walls of said housing, said flat upper surface being positioned above said top wall of said housing, a guard having side walls and a top wall sized to engage said side walls of said housing at said top wall and being removably attached to said housing, said guard being vertically adjustable and having a low limit position where a portion of the guard is in contact with said upper surface of said grinding wheel, said guard enclosing said grinding wheel and having at least one opening through said top wall thereof for access to said flat upper surface of said grinding wheel, said outer circumference of said wheel, below said bevel, remaining below said opening in said guard and not horizontally exposed through said guard opening when said guard is in said low position, a removable receptacle for storing water located in said housing, a pumping means having an inlet and an outlet being driven by a lower end of said shaft of said motor, conduit connecting said receptacle and said pump inlet for drawing water into said pump, conduit connected to said pump outlet on one end and terminating above said grinding wheel adjacent and radially outward from said inner vertical circumferential wall of said grinding wheel for supplying water to said grinding wheel, said conduit being carried within the confines of said housing and said guard along its entire length, means for collecting excess water supplied to said grinding wheel and returning said water to said receptacle for reuse, a switching means provided between said motor and source of power for selectively energizing said motor.

9. The device of claim 8, wherein said guard has a pivotable top plate adjacent said opening.

10. The device of claim 9, wherein said top plate can be selectively locked throughout a range of angles with respect to said top surface of said grinding wheel.

11. The device of claim 10, wherein said top plate has indicia associated therewith to provide for proper selection of appropriate angles to be used in sharpening various tools.

12. A device for grinding metallic objects comprising:

a housing having a bottom wall, side walls and a top wall with an opening therethrough, an electric motor enclosed within said housing and having a vertical rotatable shaft therethrough, said shaft having a top end and a bottom end extending beyond the top and bottom respectively of said motor, an annular abrasive wheel having a flat upper surface removably mounted near said top end of said shaft to corotate therewith, said grinding wheel having a bevel at the outer circumference of said upper surface whereby an outer circumference of said wheel is greater below said bevel than at said upper surface, a guard member having a top wall, side walls and an open bottom being sized to engage said side walls of said housing at said top end and being removably attached to said housing, said guard being vertically adjustable and having a low position where a portion of the guard is in contact with said upper surface of said grinding wheel, said guard member enclosing said wheel and having at least one opening through said top wall providing access to said flat upper surface of said wheel, said outer circumference of said wheel, below said bevel, remaining below and not horizontally exposed through said guard opening when said guard is in said low position, a first load bearing means through which said shaft top end is journaled below but proximate to said wheel, a removable receptacle for receiving and storing water engageable with said side wall of said housing, a pump means having an inlet and an outlet and being driven by said bottom end of said shaft, a second load bearing means through which said shaft bottom end is journaled above but proximate to said pump, first conduit means connecting said receptacle with said pump inlet, second conduit means connected to said pump outlet which directs water to said flat upper surface of said wheel, water collection means provided radially outward from said wheel and below said wheel for collecting excess water supplied to said wheel and returning said water to said receptacle for reuse.

13. The device of claim 12, wherein said guard has a slot having side walls formed in said top wall extending across the width of said guard and providing access to a chord of said wheel.

14. The device of claim 13, wherein said side walls of said slot are parallel to each other and are angled with respect to the vertical axis of said shaft.

15. The device of claim 12, wherein said guard has an inclined notch having side walls formed in said top wall providing access to said flat upper surface of said wheel.

16. The device of claim 15, wherein said side walls of said notch form a joint which is angled with respect to the vertical axis of said shaft.

17. A multi purpose electric powered whet stone comprising:

a vertically disposed shaft, casing means including, a pair of vertically spaced apart bearings for journaling said shaft, a water pump having a driven connection loading the lower end of said shaft outboard of one of said bearings, a sharpening stone having a driven connection loading the upper end of said shaft outboard of the other of said bearings, said sharpening stone having a flat upper surface with a bevel at an outer circumference of said upper surface whereby an outer circumference of said stone is greater below said bevel than at said upper surface, a motor on said shaft between said bearings for simultaneously driving said stone and said pump, said casing means including a cover formed with plural access openings for engaging articles to be sharpened to said stone, said cover vertically adjustable to a low position whereby said openings are above a lower edge of said bevel, and conduit and reservoir means inside of said casing means for circulating a stream of water including discharge means for directing the stream of water against said stone during operation.

18. The device of claim 17 wherein said plural openings include a wide opening to receive flat objects to be ground, a slot intersecting a chord of said stone for receiving scissors blades to be ground and a notch for receiving drill bits to be ground.

19. In an electric grinding machine, a vertically disposed rotatably driven shaft having an annular grinding wheel removably mounted at an upper end of said shaft, said grinding wheel having a flat upper surface and a beveled top outer edge, housing means including an adjustable guard enclosing said grinding wheel and having at least one opening therein for providing access to said flat upper surface of said grinding wheel, said opening in said guard vertically adjustable to a low position above a lower edge of said bevel but below said flat upper surface, means for adjustably positioning tools relative to said wheel including a pivotable guard plate attached to said guard adjacent said opning in said guard movable with respect to said grinding wheel, conduit means forming a closed circuit through which a supply of cooling liquid may be circulated, a pump at one point in said circuit to pressurize the liquid and drive it through said circuit in the form of a stream, a nozzle at a second point in said circuit disposed to direct said pressurized stream against said flat upper surface of said wheel, and means at a third point in said circuit for collecting excess liquid directed to said grinding wheel and recirculating said liquid to the first point in the circuit.

20. In an electric grinding machine as defined in claim 19, calibrated locking means for selectively locking said pivotable guard plate throughout a range of angles with respect to said wheel, and adjustment means for adjusting said guard upwardly and downwardly to accommodate wear of the wheel and to adjust the grinding angle.

* * * * *